US005465763A

United States Patent [19]

Egloff

[11] Patent Number: 5,465,763

[45] Date of Patent: Nov. 14, 1995

[54] THREAD HOLDER FOR A GRIPPER LOOM

[75] Inventor: Anton Egloff, Galgenen, Switzerland

[73] Assignee: Sulzer Rueti AG, Rueti, Switzerland

[21] Appl. No.: 238,408

[22] Filed: May 5, 1994

[30] Foreign Application Priority Data

May 12, 1993 [EP] European Pat. Off. ..... 93810344

[51] Int. Cl.[6] ..... D03D 47/20

[52] U.S. Cl. ..... 139/196.2; 24/136 R

[58] Field of Search ..... 139/1 C, 196.2, 139/447, 448, 215–217, 221–223, 246, 256 R; 24/136 R, 136 L; 114/218, 381; 242/419.4, 149

[56] References Cited

U.S. PATENT DOCUMENTS

| | | | |
|---|---|---|---|
| 187,063 | 2/1877 | Stevens | 139/208 |
| 3,719,211 | 3/1973 | Porter | 139/196.2 X |
| 5,083,585 | 1/1992 | Rheinganz | 139/196.2 X |

FOREIGN PATENT DOCUMENTS

| | | | |
|---|---|---|---|
| 571025 | 11/1993 | European Pat. Off. | 139/447 |
| 221745451 | 9/0674 | France . | |
| 508075 | 5/3171 | Switzerland . | |

*Primary Examiner*—Andy Falik

*Attorney, Agent, or Firm*—Townsend and Townsend and Crew

[57] ABSTRACT

A thread holder for the gripper of a gripper loom has first and second retention members which extend in a longitudinal direction. The members lie at least partially inside each other and they have opposing faces which define between them a rectilinear gap that has a curved cross-sectional shape. The second retention member is movably mounted on the first retention member so that the members can be moved with respect to each other in the longitudinal direction and so that the opposing faces provide the gap with a constant width in the longitudinal direction. The cross-sectional contour of the gap continuously increases in an effective direction of the thread holder, and the size of the gap is selected so that a weft thread inserted therein will be held by frictional force.

10 Claims, 4 Drawing Sheets

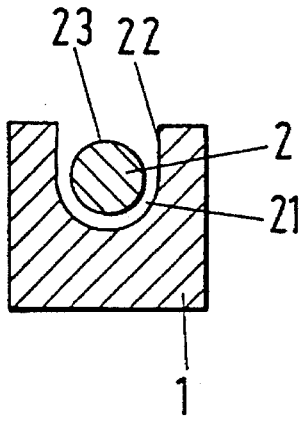
Fig.3
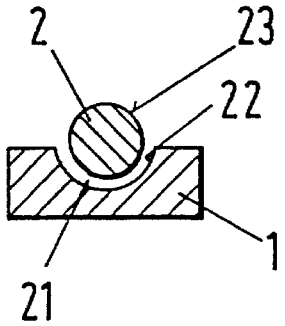
Fig.4
Fig.1
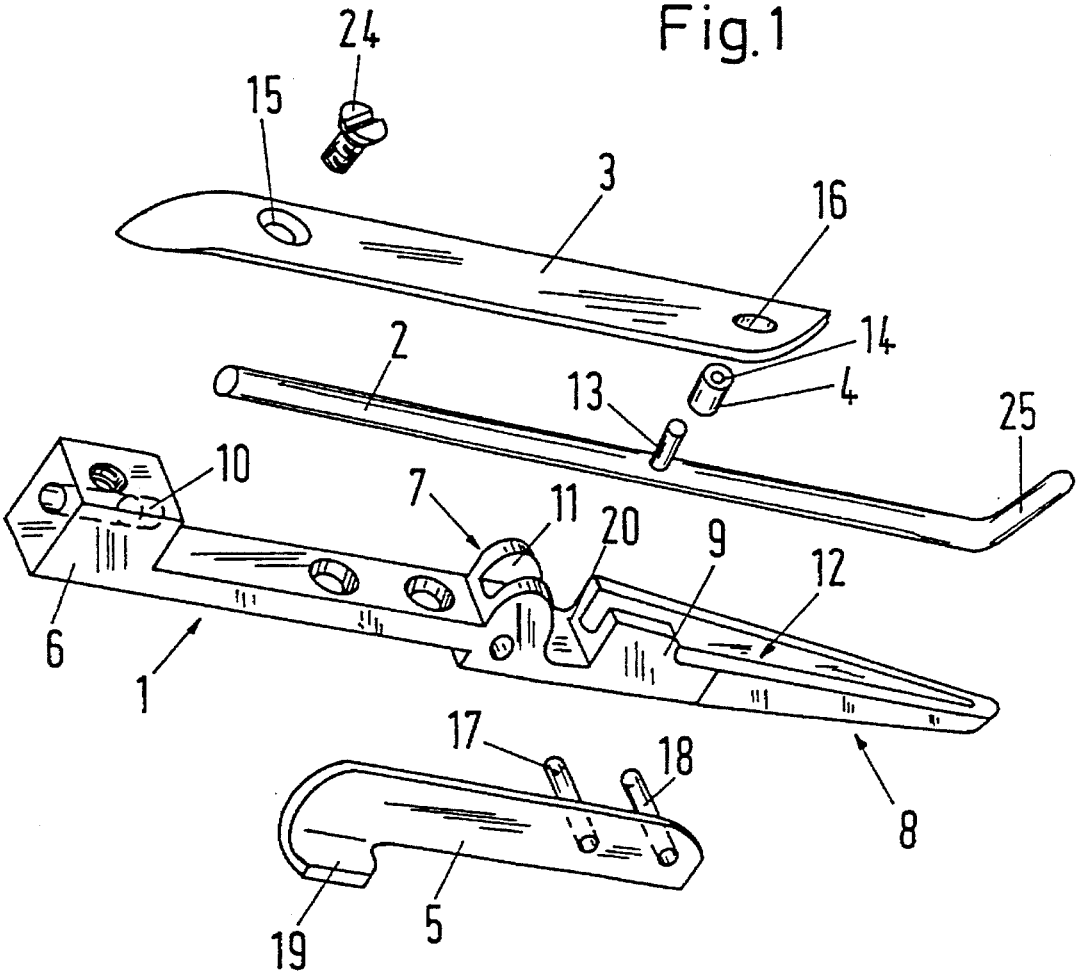

THREAD HOLDER FOR A GRIPPER LOOM

BACKGROUND OF THE INVENTION

The present invention relates to a thread holder for a gripper of a gripper loom and to a gripper loom having such a thread holder.

Published French patent application A-2,217,451 discloses a thread gripper consisting of a lower part having an attachment hole and a part similar to a needle. The lower part comprises a channel having a semi-circular cross-sectional contour, the sides of which converge slightly towards the end of the lower part. The lower part contains two pins, which are disposed spaced from one another in the channel extending along the lower part and protrude from the channel.

At the front end the needle has a curved portion in order to be able to form a feed gap and at the rear end it has a portion with two through-bores. The needle is displaceably disposed transversely to the effective direction of the thread gripper on the pins and is retained by a spring. In the position of rest the rear portion of the needle lying in the channel is raised slightly and the needle is forced by the spring against the base of the channel so that the needle lies in the feed region in the channel.

One disadvantage has proved to be that this thread gripper comprises a nip point which can be elastically stressed. As a result, the thread is subjected to significant stresses so that this thread gripper is completely unsuitable for use with fine threads.

The purpose of the present invention is to remove the disadvantage mentioned.

SUMMARY OF THE INVENTION

An object of the invention is to create a thread holder for a gripper in which a weft thread is retained without a clamping action just by surface friction.

The advantages of the thread holder of the present invention are essentially that the weft thread to be inserted is not subject to any pressure load, that several weft threads can be held, and that weft threads to be inserted in sequence or simultaneously are securely retained.

In one embodiment a bearing point and a guide point at a distance therefrom are disposed outside a gap in a longitudinal extension of the second retention member to align the faces of the first and second retention members limiting the gap with respect to one another. This has the advantages that the contours of the gap can be retained and contact between the faces limiting the gap can be avoided.

In a further embodiment the first retention member comprises an oblong recess having a semi-circular base and having a cross-sectional contour increasing in the effective direction, which forms one face limiting the gap, and the second retention member is a needle having a constant, circular cross-sectional contour which forms the other face limiting the gap. By the increase in the cross-sectional contour of the recess, an increasing looping and consequently a greater frictional area can advantageously be produced.

It is advantageous if a shoulder is provided at the first retention member in order to limit the effective length of the gap. As a result several weft threads can be housed in the gap.

In another embodiment a device is disposed at the first retention member for actuating the second retention member to thereby open the gap. This has the advantage that thread waste and impurities are removed without any residue and can not get into the fabric and also make a perfect thread retention always possible.

It is advantageous if the device is a member which is pivoted on the first retention member and is effectively connected with the second retention member to open the gap and comprises a restoring member to reset the gap. As a result the thread holder can be automatically opened within the weaving cycle. The function of the thread holder may advantageously be improved if a driving mechanism, e.g. an electromagnet, is provided for the member.

It is also advantageous if the member comprises guide means for the second retention member. Thus guidance on all sides of the second retention member, which can move in the longitudinal extension, is effected.

The invention is explained below by means of the attached drawings.

BRIEF DESCRIPTION OF THE DRAWINGS

FIG. 1 shows an embodiment of a thread holder according to the invention in an exploded representation;

FIG. 3 shows a section along line III—III in FIG. 2;

FIG. 4 shows a section along line IV—IV in FIG. 2;

DESCRIPTION OF THE PREFERRED EMBODIMENTS

Figure 2:
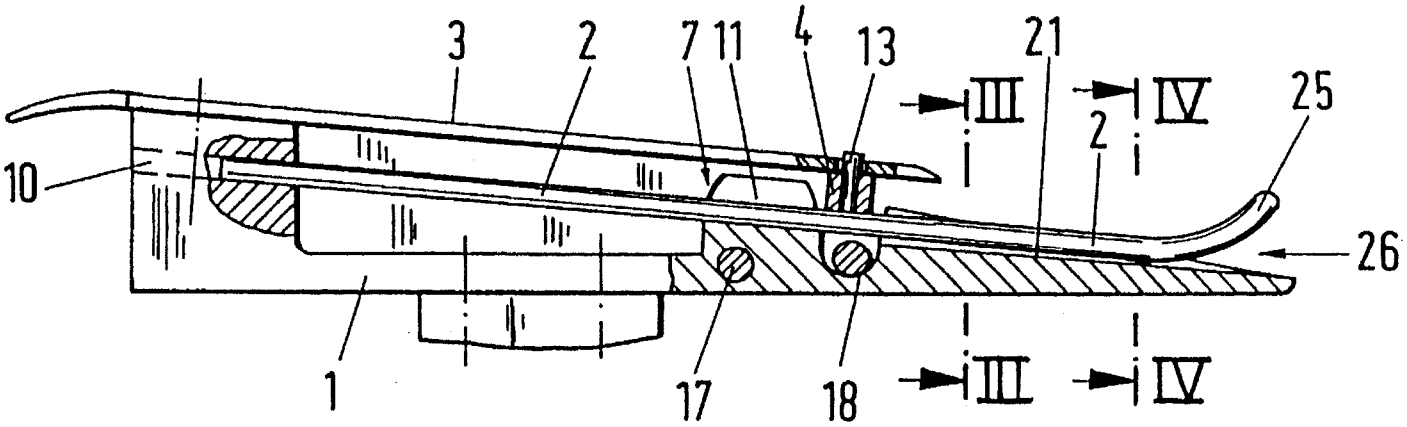
FIG. 2 shows a longitudinal section of the thread holder represented in FIG. 1.

Referring to FIG. 1, the thread holder essentially consists of a first retention member 1, hereinafter called the base member, a second retention member 2, hereinafter called the needle, a restraint member 3, a tube 4 and a two-armed lever 5.

The base member 1 contains a portion 6 on one end of the base member, a guide portion 7, which is spaced from portion 6 on the base member 1, and a retention portion 8, which tapers to the other end of the base member 1. It is particularly advantageous if the distance between portion 6 and retention portion 8 is at least 10 mm. Retention portion 8 has least one shoulder 9 which forms a stop for the thread and prevents the thread from being drawn through in the longitudinal direction of the thread holder. Portion 6 includes a bore 10 into which one end of the needle 2 can be introduced. The guide portion 7 has a recess 11 into which the needle 2 can be inserted. In the retention portion 8 is a channel-shaped recess 12 extending to the end of the base member 1, above which the needle 2 comes to lie.

The needle has a circular cross-section and has a peg 13. The tube 4 has a through hole 14, the cross-sectional shape of which is adapted to that of the peg. The restraint member is a leaf spring 3, which comprises a countersunk through bore 15 and a slot 16. The two-armed lever 5 has a pivot pin 17 which determines the swivel axis of the lever. The lever 5 is pivoted on the base member 1. To one lever arm is attached a pin 18 and on the other lever arm is formed a tab 19. Base member 1 has a U-shaped recess 20 which extends transversely to the needle axis.

As FIG. 2 shows, the needle 2 is housed at one end in the bore 10 in portion 6 used as the bearing point. It is laterally guided and supported in the recess 11 used as a supporting point and is disposed at a distance from the inner face of recess 12. To achieve this arrangement during the manufacture of the base member 1 according to the invention, a single recess, e.g. a bore, is formed, which determines the contours of the bearing 10 and supporting point 11 and predetermines the contours of recess 12. By subsequent machining of the recess 12 a gap 21 according to the invention is produced.

The gap 21 is firstly limited by the inner, concave face 22 of the recess 12 and secondly by the outer, convex face 23 of the needle 2. By the arrangement of the needle 2 in the base member 1, which is described above, a gap 21 having a curved cross-sectional shape is formed. It has a constant width in the effective direction of the thread holder and, transversely thereto, a continuously increasing cross-sectional contour, as can be seen by comparing the cross-sectional contours illustrated in FIGS. 3 and 4. The gap width is at least 0.005 mm.

By this formation of the recess 12 according to the invention, the looping by the weft thread to be drawn in (not shown) increases and consequently so does the surface friction. As a result a secure retention of the weft thread is guaranteed.

On the peg 13 is disposed the tube 4. On this tube 4 lies the leaf spring 3, through which the peg 13 penetrates in order to guide the needle 2 with respect to the recess 12 of the thread holder. The leaf spring 3 is also attached to portion 6 by means of a screw 24 which 24 simultaneously prevents the needle 2 from being pulled out without obstructing its mobility inside the bore in the longitudinal extension.

To guarantee a perfect feed of this thread, the free end of the needle 2 has a curved portion 25 to form a substantially V-shaped feed gap 26.

Figure 5:
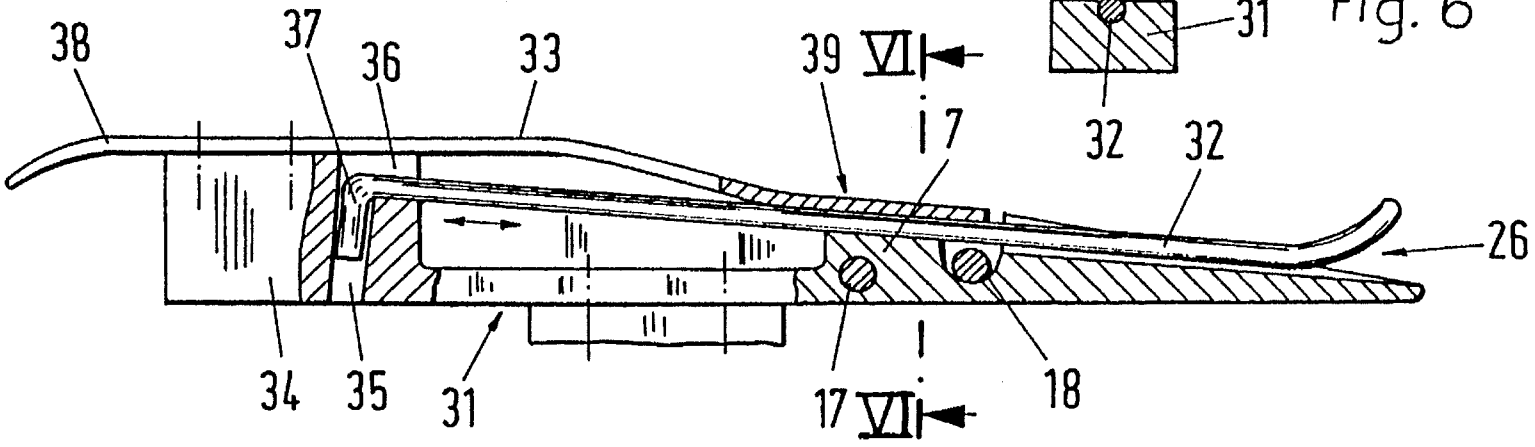
FIG. 5 shows a longitudinal section the same as in FIG. 2 of another embodiment of a thread holder according to the invention.

The thread holder shown in FIG. 5 has substantially the same basic configuration as the thread holder described above, so that only features which differ are described below.

In this embodiment of the thread holder the base member 31, the needle 32 and the restraint member 33 are modified.

In the preceding description the needle had a circular cross-section. However it is also possible to use a needle having a different cross-sectional shape.

In a portion 34 of the base member 31 is a through-bore 35 directed transversely to the effective direction of the thread holder, which on the upper side opens into a groove 36. The needle 32 has a portion 37 bent at a right angle, which is disposed in the through-bore 35 with clearance so that the needle 32 is movably mounted. The needle 32 is disposed and guided in a channel having a semi-circular cross-sectional contour in the guide portion 7.

Figure 6:
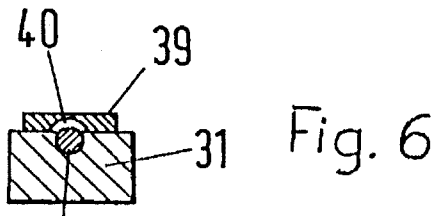
FIG. 6 shows a section along line VI—VI in FIG. 5.

The restraint member is a leaf spring 33, which is retained at portion 34 by means (not represented) so that a downwardly curved end portion 38 extends past portion 35 to prevent an engagement in the warp thread sheet with the return of the gripper head. On the other end the leaf spring 33 comprises a portion 39 which has a channel 40 extending in the longitudinal direction of the leaf spring and having a semi-circular contour (FIG. 6).

The leaf spring 33 is constructed so that portion 39 overlaps both sides of the channel 40 on the guide portion and between the leaf spring 33 and the needle 32 there is a gap for the displacement of the needle 32 in the channel 40.

Figure 7:
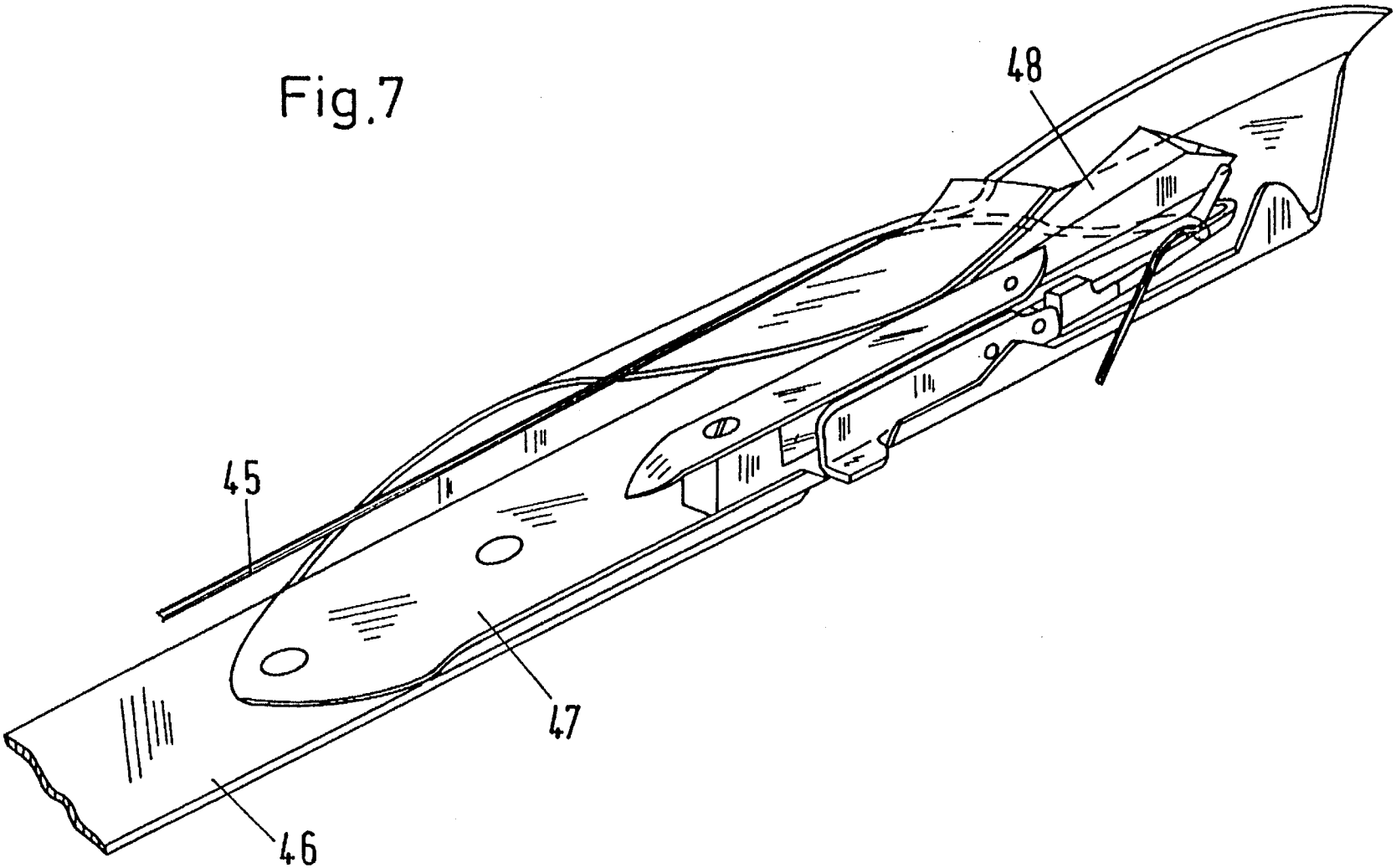
FIG. 7 shows a three-dimensional representation of a gripper head with a thread holder as shown in FIG. 1.

FIG. 7 shows a gripper head having a thread holder as shown in FIG. 1 and a weft thread 45 held therein. A per se known gripper body 47 is attached to a strip 46. A directing member 48 is mounted on the side of gripper body 47 turned towards the reed (not represented). The thread holder is disposed next to this directing member 48 so that the weft thread 45 to be inserted is deflected firstly by the gripper member 47 and by the directing member 48 and secondly as a result the tensile force acting on the weft thread is for the most part intercepted. As a result the retention force to be applied is substantially less and consequently fewer thread breakages occur, which is an advantage.

Figure 8:
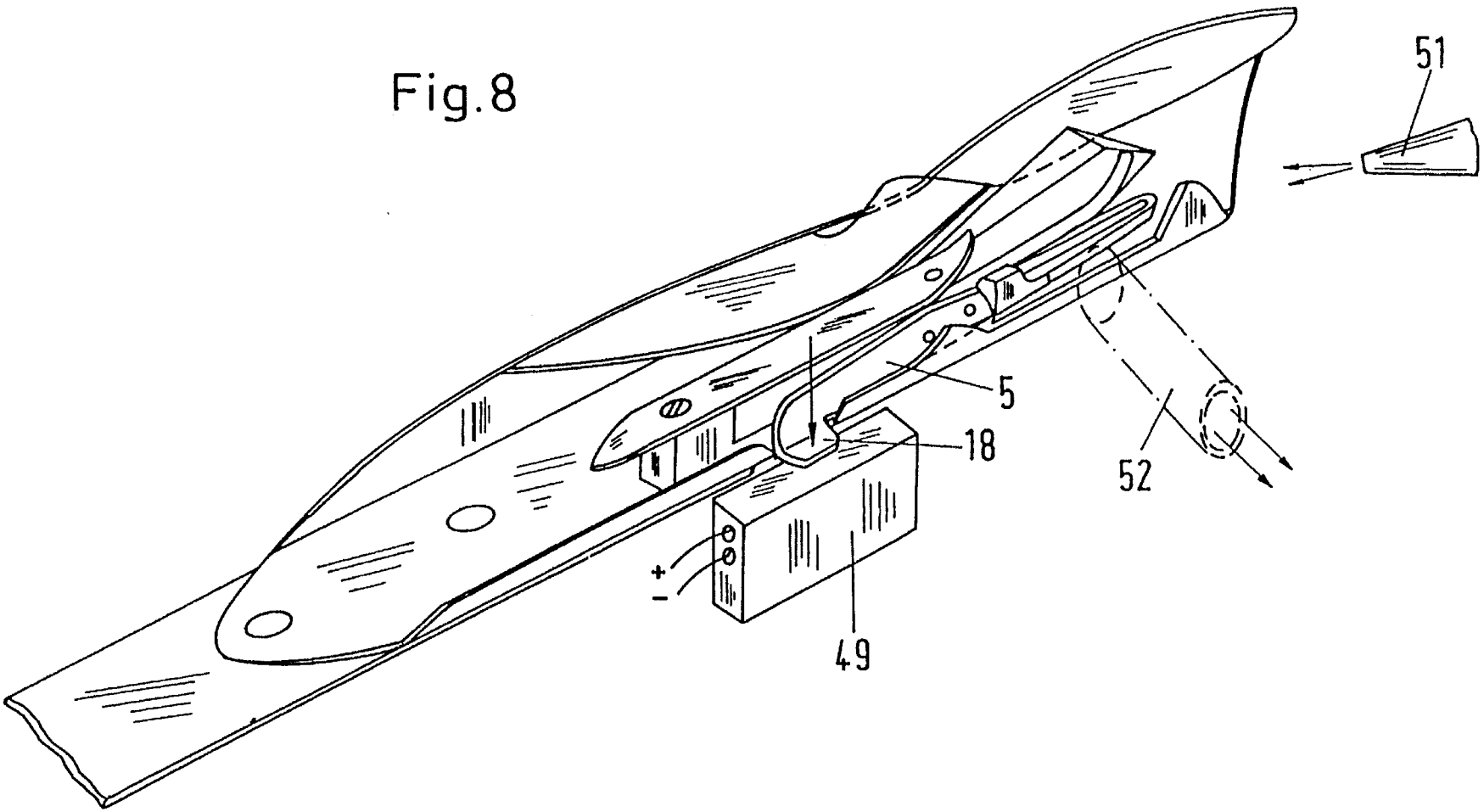
FIG. 8 shows a three-dimensional representation of the gripper head with an open gap for cleaning the thread holder.

FIG. 8 shows the gripper head shown in FIG. 7 in a position before the weft insertion operation. In this position the thread holder is open. For this purpose an electromagnet 49 is provided which is disposed on the gripper loom so that the tab 18 formed on the lever 35 enters into the field of force of the electromagnet 49 and is attracted thereby.

The lever 5 is swivelled around the pivot pin 17 and the pin 18 is brought into effective engagement with the needle 2. As a result the needle 2 is raised against the force of the leaf spring 3 from the recess 12. In this position the thread holder is cleaned by a blowing device 51 and a suction device 52.

What is claimed is:

1. A thread holder for a gripper of a gripper loom comprising first and second retention members extending in a longitudinal direction, lying at least partially inside one another and having opposing faces which define between them a rectilinear gap having a curved cross-sectional shape, means movably mounting the second retention member on the first retention member so that the members are movable relative to each other in the longitudinal direction and so that the opposing faces provide the gap with a constant width in the longitudinal direction and with a cross-sectional contour which continuously increases in an effective direction, the size of the gap being such that a weft thread inserted therein will be held by frictional force.

2. A holder according to claim 1, including a bearing point and a guide point spaced therefrom, which are disposed along the longitudinal direction of the second retention member and outside the gap of the first and second retention member.

3. A holder according to claim 1, wherein the first retention member comprises an elongated recess having a semi-circular base, a cross-sectional contour increasing in the effective direction, and forming one of the faces, and wherein the second retention member is a needle having a constant cross-sectional contour and forming the other one of the faces.

4. A holder according to claim 1, wherein the first retention member includes a shoulder limiting an effective length of the gap.

5. A holder according to claim 1, including a mechanism disposed on the first retention member for operating the second retention member and for opening the gap for cleaning and resetting it.

6. A holder according to claim 5, wherein the mechanism comprises a member which is pivotably mounted on the first retention member for being brought into active connection with the second retention member for opening the gap (21), and a restoring member for resetting the gap.

7. A holder according to claim 6, wherein the restoring member is elastically deformable.

8. A holder according to claim 6, wherein the restoring member comprises guide means for the second retention member.

9. A holder according to claim 5, wherein the mechanism includes a movable member and a driving mechanism for the movable member.

10. A gripper loom comprising a thread holder including first and second retention members extending in a longitudinal direction lying at least partially inside one another and having opposing faces which define between them a rectilinear gap having a curved cross-sectional shape, means movably mounting the second retention member on the first retention member so that the members are movable relative to each other in the longitudinal direction and so that the opposing faces provide the gap with a constant width in the longitudinal direction and with a cross-sectional contour which continuously increases in an effective direction, the size of the gap being such that a weft thread inserted therein will be held by frictional force, and a cleaning device for the thread holder.

* * * * *